United States Patent [19]

Tashiro

[11] 4,182,941

[45] Jan. 8, 1980

[54] IMPROVED PRESSURE SWITCH

[75] Inventor: Fuminori Tashiro, Tokorozawa, Japan

[73] Assignee: Kabushiki Kaisha Saginomiya Seisakusho, Tokyo, Japan

[21] Appl. No.: 895,278

[22] Filed: Apr. 10, 1978

[30] Foreign Application Priority Data

Aug. 3, 1977 [JP] Japan ..... 52/103310[U]

[51] Int. Cl.[2] ..... H01H 35/32

[52] U.S. Cl. ..... 200/83 C; 200/83 S

[58] Field of Search ..... 200/83 S, 83 C, 83 D, 200/83 R, 81 R

[56] References Cited

U.S. PATENT DOCUMENTS

| | | | |
|---|---|---|---|
| 1,867,711 | 7/1932 | Raney | 200/83 C |
| 2,475,069 | 7/1949 | Wood | 200/83 C |
| 2,584,682 | 2/1952 | Eimermann | 200/83 S |
| 2,773,147 | 12/1956 | Judson | 200/83 S |

*Primary Examiner*—Gerald P. Tolin

*Attorney, Agent, or Firm*—Lackenbach, Lilling & Siegel

[57] ABSTRACT

A pressure switch assembly comprising a bellows expansible in response to a working pressure, an L-shaped actuating plate pivotably responsive to the expansion of the bellows and actuating a microswitch, an adjustable compression spring arranged against the bellows, an adjustable tension spring connected against the compression spring through the actuating plate and a stopper of the tension spring. The arrangement of the tension spring, the actuating plate and the stopper is simplified by making the spring directly connect with the actuating plate to eliminate a connection member.

5 Claims, 5 Drawing Figures

IMPROVED PRESSURE SWITCH

BACKGROUND OF THE INVENTION

The present invention generally relates a pressure-responsive switch assembly including a first spring and a second spring designed such that, when a microswitch is turned on or off, the first spring alone counteracts a working pressure and, under other conditions, the action of the first spring is suppressed by the second spring. More particularly, the present invention is concerned with such a switch assembly having an improved device for anchoring the second spring.

A pressure switch of such type is disclosed in Japanese Utility Model Publication No. 37-14418 (1962). One preferred embodiment of the prior art pressure-responsive switch of such type comprises, as shown in the attached drawings (FIGS. 1 and 2), a bellows (12) which is secured around an opening provided in the wall of a casing (1) and is connected to a pressure source. The free end of the bellows (12) is engaged by a generally L-shaped actuating member or plate (8) pivotably connected to the casing (1) to turn about a fulcrum (15) because of the action of the bellows. A first or compression spring (6) has one end thereof abutted against the actuating plate (8) at a vertical arm portion (8*b*) in opposing relation to the secured to one end to the side wall of the casing (1) through an adjusting screw (3) and extends and has horizontally a point contact member at its other end which contacts the vertical arm portion of the L-shaped actuating member or plate. The adjusting screw (3) is rotatably secured to the casing wall and can adjust the resilient force of the first spring (6). The actuating plate has a lateral arm portion (8*b*) which engages with a contact member (11) of a microswitch (10) to open and close the switch. The vertical arm position (8*b*) of the actuating plate is connected to one end of a second or tension spring (5) by means of a connecting plate (14) for distributing pressure differential. The end portion of the vertical arm portion (8*b*) is loosely engaged with an opening provided in the connecting plate (14) which has another opening holding a hook end portion of the second spring (5). The movement of the plate (14) is limited to a predetermined range by a stopper (7). The second spring (5) is also secured to the side wall of the casing (1) and laterally extends parallel to the first spring (6). The second spring (5) resilient force may be adjusted by means of a screw (2) also rotatably secured to the side wall of the casing (1). FIG. 1 shows a situation of the switch assembly in which the bellows has contracted due to the drop or lowering of the pressure maintaining the microswitch (10) in the off-state. FIG. 2 illustrates the on-state of the microswitch derived from an increase in the pressure.

When the pressure acting in the bellows increases in the situation depicted in FIG. 1, the bellows expands causing the actuating plate (8) to move clockwise about the fulcrum (15) so that the contact member (11) of the microswitch is depressed by the arm portion (8*a*) of the actuating plate. Meanwhile, the connecting plate (14) anchored to the other arm portion (8*b*) of the actuating plate is pulled to the right as viewed in the drawing under the action of the second spring (5) until its movement is limited by the stopper (7). The second spring thus stopped can not impart its force to the actuating plate so that the pressure inside the bellows is opposed by the force of the first spring (6) alone. When a predetermined pressure selected by the screw (3) is reached, the contact member (11) is depressed thus turning the microswitch on as best shown in FIG. 2. Conversely, when the pressure inside the bellows drops or falls under the conditions depicted in FIG. 2, the first spring (6) urges the actuating plate (8) counterclockwise about the fulcrum (15). However, the actuating lever has the movement of its arm portion (8*b*) suppressed by the second spring (5) anchored to the plate (14) and, hence, the pressure acting in the bellows is counteracted by the difference between the force of the first spring and that of the second spring. In other words, the composite force of the pressure inside the bellows and the force of the second spring essentially counteracts the force of the first spring. Accordingly, the situation of FIG. 1 in which the microswitch (10) is switched off is not restored unless the pressure inside the bellows undergoes an extra drop or fall corresponding to the force of the second spring. The resilient force of the second spring (5) is adjustable by the screw (2).

SUMMARY OF THE INVENTION

The switch assembly of the present invention is an improvement over and also overcomes the deficiencies of the prior art pressure responsive switch assembly as described above.

An object of the present invention is to provide a pressure-respective switch assembly of simple construction while maintaining the required conditions of switch operation.

Another object of the present invention is to provide a pressure-responsive switch assembly of a simple construction enabling easy assembling, while maintaining the requirements for a precisely wide range of adjustment of the switching characteristic.

The above and other objects of the present invention are achieved by providing a novel pressure-responsive switch assembly which performs such actions without resort to the connection member of the plate which was used in the prior art switch assembly for connecting the actuating member or plate and the second spring and making the free end portion of the second spring directly contact with the contact ends of the actuating plate and the stopper.

In accordance with the present invention, there is provided a pressure-responsive switch assembly comprising a casing, an opening provided in the casing to communicate with a pressure source, a bellows at its open end secured around the opening, a generally L-shaped actuating plate engaged at its one arm portion with the free end of said bellows, a microswitch having a contact member engaged by the other arm portion of said actuation plate, a first spring secured at one end to the casing and at its other end abutted against said one arm portion of said actuating plate to counteract the pressure inside said bellows, a screw for adjusting the resilient force of said first spring, a second spring at one end connected to the casing and extending substantially parallel to the first spring, the second spring connected to a free end of said one arm portion of the actuating plate, a screw for adjusting the resilient force of said second spring, a stopper retaining the secon[illegible] spring, and the second spring and the free end of said one arm portion being engaged within a limited range.

DETAILED DESCRIPTION OF THE PREFERRED EMBODIMENT

Figure 1:
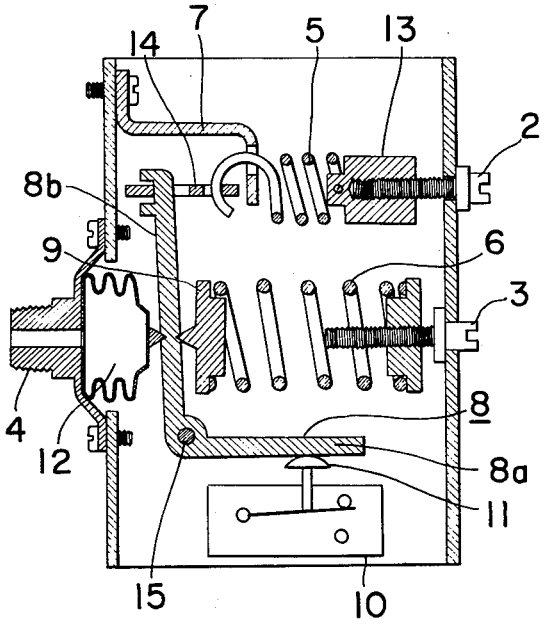
FIG. 1 PRIOR ART
FIG. 1 is a sectional view of a prior art pressure-responsive switch assembly in which the microswitch is shown schematically in the OFF position.

The present invention will now be described with respect to a novel structure which is different from a prior art switch assembly, such as those shown in FIGS. 1 and 2, but which maintains common structures and references numerals of the above noted Figures.

The second spring (5) has at its free end a semi-circular hook portion (5*a*) extending in a plane parallel to the axis of the spring (5). A stopper or bent plate (7) is secured to a side wall of the casing (1) by a securing screw (21) and has a lateral portion (7*a*) and a downwordly extending or vertical portion (7*b*). The vertical portion (7*a*) has a relatively large opening (22) through which the hook end portion (5*a*) of the second spring (5) extends. The free end of the vertical portion (7*b*) has a stop (7*c*) of substantially hook shape which is adapted to contact with the inner side of the hook portion (5*a*) of the second spring (5). The vertical arm portion (8*b*) of the L-shaped lever (8) also has at its upper end a contact end portion (8*c*) which is also adapted to contact with the inner side of the hook end (5*c*) of the second spring (5).

Figure 2:
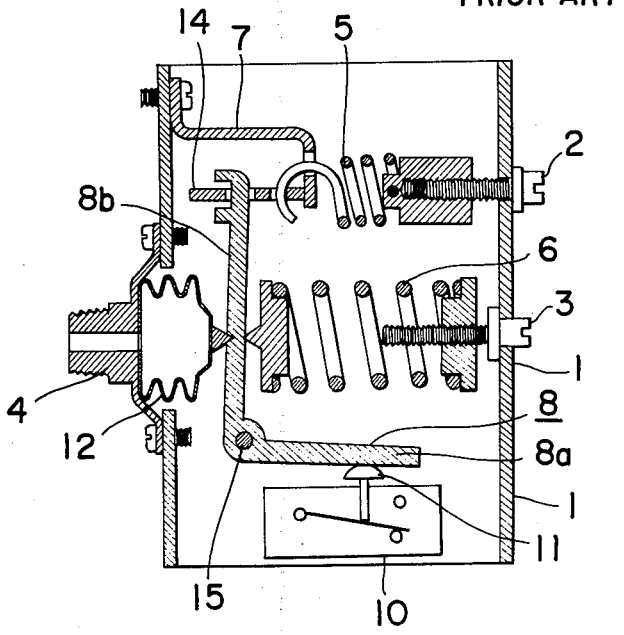
FIG. 2 PRIOR ART
FIG. 2 is a sectional view of the prior art pressure-responsive switch assembly of FIG. 1, but in which the micro-switch is in the ON position.

A pressure switch according to the present invention is free from the connecting plate (14) shown in FIGS. 1 and 2 of the prior art switch assembly and has the second spring (5) anchored to the bent plate or stopper (7) while permitting the extreme end of the vertical arm portion (8*b*) of the actuating L-shaped plate or lever to engage with the second spring (5) only when the microswitch 10 is turned off.

Figure 3:
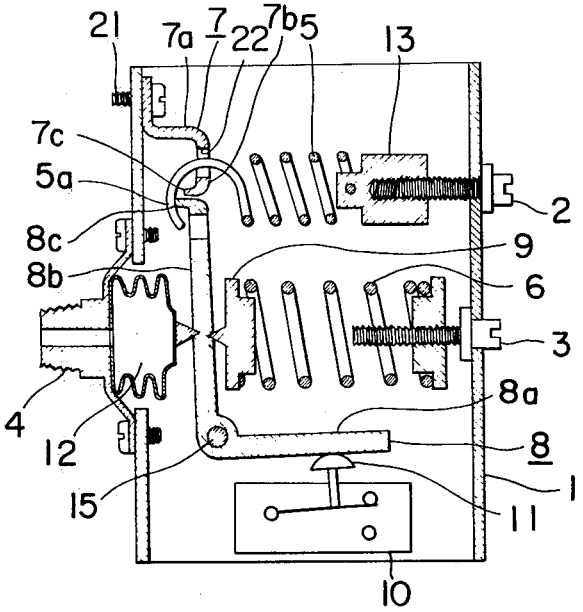
FIG. 3 is a sectional view showing one embodiment of a pressure-responsive switch assembly according to the present invention in which the microswitch is shown schematically in the OFF position.
Figure 4:
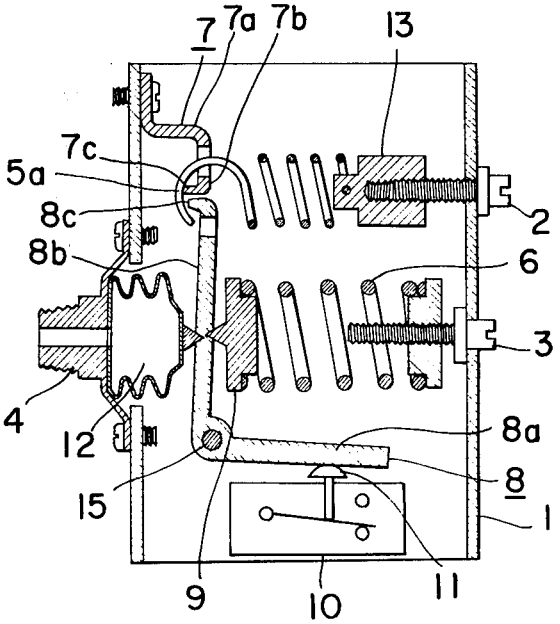
FIG. 4 is a sectional view of the switch assembly of FIG. 3, in which the micro-switch is shown schematically in the ON position.

With this arrangement when the pressure inside the bellows (12) is increased, the actuating plate or L-shaped lever (8) is moved to the right side of the Figures or clockwise about the pivot (15) of the L-shaped lever (8), which in turn releases its force on the hook end portion (5*a*) of the second spring (5), so that the second spring is then retained by the stop (7*c*) and no force is imparted to the actuating plate or L-shaped lever (8). Consequently, the pressure inside the bellows is opposed by the force of the first spring (6) (situation shown in FIG. 4 and FIG. 2 of the prior art). As the pressure inside the bellows falls, the first spring (6) urges the actuating plate or L-shaped lever (8) counterclockwise about its pivot (15) until the extreme end of the arm portion (8*c*) engages with hook (5*a*) and pulls and tensions the second spring (5), thereby suppressing the angular movement of the arm portion (8*b*) (situation shown in FIG. 3).

It will now be appreciated from the foregoing that, since a pressure switch according to the present invention dispenses with a differential pressure distribution plate included in a prior art switch assembly as shown in FIGS. 1 and 2 and yet surely performs the expected function, it is advantageous in that the cost for the pressure distribution plate is eliminated, the cost of machining an L-shaped actuating plate is reduced and that the number of assembling steps is reduced.

Figure 5:
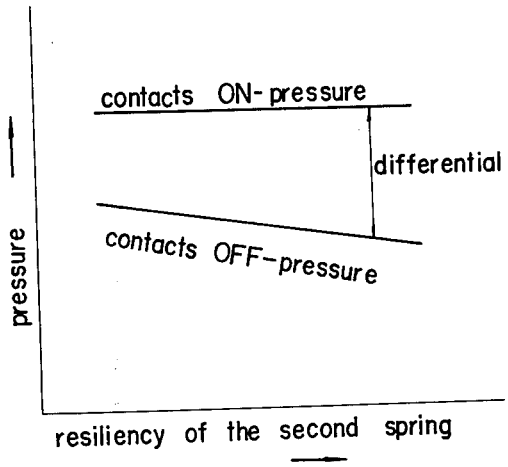
FIG. 5 is a graphical representation of the operation of a pressure-responsive switch assembly according to the present invention.

Operated as described above, the pressure switch as indicated in FIG. 5 has its contact closed at a constant pressure and opened at a variable pressure dictated by the adjustable resilient force of the second spring. The difference between the on and off pressures (differential) is adjustable in this way.

What we claim:

1. A pressure switch comprising a casing having an opening therethrough;

a bellows having an opening adapted for high pressure and low pressure conditions secured to said casing opening at its open end, and its closed end projecting inside said casing;

a microswitch provided within the casing and having a contact member;

an actuating plate provided inside the casing and pivotable on a fulcrum; said actuating plate including a first arm portion and a second arm portion, said first arm portion abutting against the closed end of said bellows and said second arm portion abutting against said contact member;

a compression spring mounted at one end to said casing and abutting at its other end against the first arm portion of said actuating plate to counteract any inflation of said bellows;

a tension spring extending substantially parallel to said compression spring, and being mounted to the casing at one end, and said tension spring having a curved hook portion at its other end; and a stopper secured to said casing, and extending substantially in proximity to said tension spring and said first arm portion, and having an opening; the curved hook portion of said tension spring loosely extending through said opening in direct engagement with only said stopper at high pressure, and in direct engagement with only said first arm portion of the actuating plate at low pressure.

2. A pressure switch as set forth in claim 1, wherein said actuating plate is a generally L-shaped member.

3. A pressure switch as set forth in claim 2, wherein said fulcrum pivotably supports the actuating plate at the corner of said L-shaped member formed by said first and second arm portions.

4. A pressure switch as set forth in claim 3, wherein said curved hook portion of said tension spring is adapted to engage with said first arm portion at its distal end.

5. A pressure switch as set forth in claim 4, further including first adjusting means for adjusting the compression of said compression spring and second adjusting means for adjusting the tension of said tension spring.

* * * * *